United States Patent [19]

Mortensen et al.

[11] Patent Number: 4,951,321

[45] Date of Patent: Aug. 28, 1990

[54] NOVELTY UNDERGARMENT

[76] Inventors: James D. Mortensen; Theresa L. Mortensen, both of 10326 Karmont Ave., Southgate, Calif. 90280

[21] Appl. No.: 343,836

[22] Filed: Apr. 25, 1989

[51] Int. Cl.[5] ..... A41B 9/04

[52] U.S. Cl. ..... 2/408; 2/405

[58] Field of Search ..... 2/405, 408, 400

[56] References Cited

U.S. PATENT DOCUMENTS

| | | | |
|---|---|---|---|
| 4,280,230 | 7/1981 | LaFleur | 2/408 |
| 4,446,575 | 5/1984 | Davis | 2/408 X |
| 4,807,304 | 2/1989 | McCants-Reed | 2/405 |
| 4,835,795 | 6/1989 | Lonon | 2/408 |

FOREIGN PATENT DOCUMENTS

| | | | |
|---|---|---|---|
| 220819 | 9/1957 | Australia | 2/408 |
| 208956 | 4/1909 | Fed. Rep. of Germany | 2/408 |
| 684104 | 11/1939 | Fed. Rep. of Germany | 2/405 |

*Primary Examiner*—Werner H. Schroeder
*Assistant Examiner*—Diana L. Biefeld
*Attorney, Agent, or Firm*—Leon Gilden

[57] ABSTRACT

A novelty undergarment including a continuous elastomeric waistband with downwardly depending legs defined by horizontal lowermost edges with the undergarment including a removable cup-shaped rear panel and a removable cup-shaped forward panel. The rear panel overlies a "D" shaped perimeter wherein the cup-shaped forward panel overlies a tapering perimeter extending downwardly from a rectangular uppermost opening wherein the forward and rear panels are securable by means of continuous hook and loop perimeter fastener strips to selectively secure the panels to overlie respective openings.

1 Claim, 1 Drawing Sheet

NOVELTY UNDERGARMENT

BACKGROUND OF THE INVENTION

1. Field of the Invention

The field of invention relates to undergarment construction, and more particularly pertains to a new and improved novelty undergarment wherein the same is provided with removable forward and/or rear panels.

2. Description of the Prior Art

The use of undergarments and their construction for specialized applications is well known in the prior art. The undergarment of the instant invention attempts to overcome deficiencies of the prior art by providing removable forward and/or rear panels in association with the undergarment. An example of undergarment construction may be found in U.S. Pat. No. 4,501,024 to Russo defining a bathing trunk organization wherein the bathing trunk has formed therein triangular type openings for exposing a wearer's buttocks for enhancement of appearance of a wearer of the device.

U.S. Design Pat. Nos. 230,538; 165,812; 286,100; and 275,524 set forth a series of various configurations of bathing suit and undergarment construction, as may be typically found in the prior art.

As may be appreciated, there continues to be a need for a new and improved novelty undergarment wherein the same addresses the problem of effectiveness in construction to enable removal of panels selectively securable to forward and/or rear portions of an undergarment and further addresses the problem of ease of use of such undergarment, and in this respect, the present invention substantially fulfills this need.

SUMMARY OF THE INVENTION

In view of the foregoing disadvantages inherent in the known types of undergarments now present in the prior art, the present invention provides a novelty undergarment wherein the same utilizes removable panels forwardly and/or rearwardly oriented relative to the undergarment. As such, the general purpose of the present invention, which will be described subsequently in greater detail, is to provide a new and improved novelty undergarment which has all the advantages of the prior art novelty undergarments and none of the disadvantages.

To attain this, the present invention sets forth an undergarment formed with a continuous waistband with downwardly depending legs each terminating in horizontal lowermost edges. A removable cup-shaped panel of a generally "D" shaped opening perimeter securable to a "D" shaped perimeter formed about a rear opening of the undergarment. The forward panel defines a rectangular opening in communication with a downwardly tapering opening with a hook and loop fastener strip continuously formed at the opening for overlying securement of the forward panel thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty undergarment which has all the advantages of the prior art novelty undergarments and none of the disadvantages.

It is another object of the present invention to provide a new and improved novelty undergarment which may be easily and efficiently manufactured and marketed.

It is a further object of the present invention to provide a new and improved novelty undergarment which is of a durable and reliable construction.

An even further object of the present invention is to provide a new and improved novelty undergarment which is susceptible of a low cost of manufacture with regard to both materials and labor, and which accordingly is then susceptible of low prices of sale to the consuming public, thereby making such novelty undergarments economically available to the buying public.

Still yet another object of the present invention is to provide a new and improved novelty undergarment which provides in the apparatuses and methods of the prior art some of the advantages thereof, while simultaneously overcoming some of the disadvantages normally associated therewith.

Still another object of the present invention is to provide a new and improved novelty undergarment wherein the same utilizes removable panels defined by a forward and rear panel selectively securable to overlie forward and rear openings utilizing hook and loop fastener perimeter securement means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
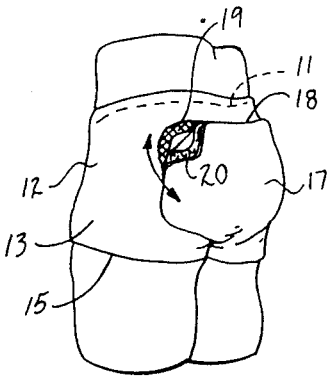
FIG. 1 is a rear isometric illustration of the instant invention.

With reference now to the drawings, and in particular to FIGS. 1 to 5 thereof, a new and improved novelty undergarment embodying the principles and concepts of the present invention and generally designated by the reference numeral 10 will be described.

More specifically, the novelty undergarment 10 of the instant invention essentially comprises a continuous elastomeric waistband 11 positioned interiorly of a torso band 12 which further defines a left leg component 13 and a right leg component 14 extending downwardly and orthogonally relative to the elastomeric waistband 11 terminating in a horizontal left edge 15 and a horizontal right edge 16 respectively.

Figure 2:
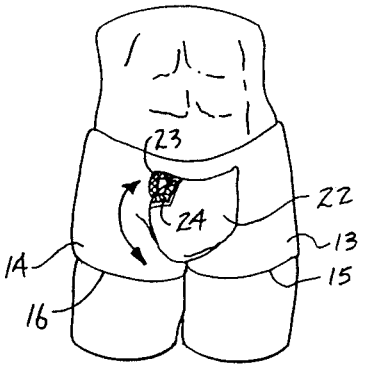
FIG. 2 is a forward isometric illustration of the instant invention.
Figure 3:
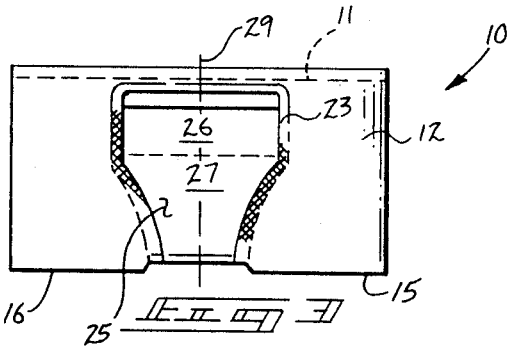
FIG. 3 is a frontal orthographic view, taken in elevation, of the instant invention.
Figure 4:
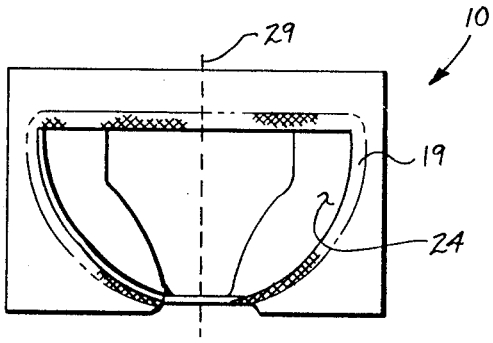
FIG. 4 is a rear orthographic view, taken in elevation, of the instant invention.

The undergarment 10 includes a cup-shaped rear panel 17 extending rearwardly of the cup shaped forward panel 22 wherein the forward and rear panels 17 and 22 respectively are symmetrically defined about a bisecting plane 29 positioned medially of the undergarment 10. The utilization of downwardly extending leg components 13 and 14 respectively are utilized to enhance the structural integrity and positioning of the undergarment 10 when worn by a user when the forward and rear panels are selectively removed to maintain the undergarment in a predetermined orientation relative to a user's body, as the leg components will maintain the orientation of the undergarment by their engaging a larger surface area of an individual's leg, as illustrated in FIGS. 1 and 2 for example, to resist shifting of the undergarment when the respective forward and rear panels are removed.

Figure 5:
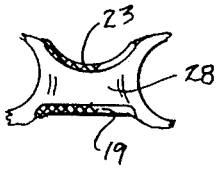
FIG. 5 is a bottom orthographic view of the instant invention.

The cup-shaped rear panel 17 includes a "D" shaped rear panel perimeter edge 18 engageable with a "D" shaped hook and loop continuous strip 19 formed about the "D" shaped rear opening 21. The perimeter 18 includes a coacting second hook and loop strip 20 to coact with the first hook and loop "D" shaped strip 19. The forward cup-shaped panel 22 includes a first forward hook and loop strip 23 continuously formed about the forward opening 25 and includes a first forward hook and loop fastener strip 23 formed about the perimeter edge of the forward opening 25 to cooperate with a second forward hook and loop fastener strip 24 formed interiorly of the forward cup-shaped panel 22 adjacent the exterior perimeter thereof. The forward opening 25 is defined by an upper rectangular section 26 communicating with a downwardly tapering bottom section 27 to define the opening. The forward and rear openings are separated by connecting web 28, as illustrated in FIG. 5, to space the forward and rear openings 21 and 25 respectively.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A novelty undergarment organization comprising, a torso supported undergarment defined by a continuous waistband overlying a continuous elastomeric band with a left downwardly depending leg component oriented adjacent a right downwardly depending leg component, and a rear opening formed with the band and overlying the left and right leg component including a removably mounted rear cup-shaped panel removably overlying the rear opening, and a forward opening formed within a forward section of the band overlying forward portions of the right and left leg components including a removably mounted cup-shaped panel selectively secured overlying the forward opening, and wherein the forward and rear openings are symmetrically arranged about a plane bisecting the waistband wherein the plane is formed medially of the waistband and oriented between the right and left leg components, and wherein the forward opening includes a forward continuous hook and loop fastener strip arranged about the forward opening adjacent a forward edge defining the forward opening, and wherein the forward panel is of a complementary configuration to the forward opening and includes a continuous forward panel hook and loop fastener strip arranged adjacent an exterior edge of the forward opening to selectively cooperate with the forward opening hook and loop fastener strip, and wherein the forward opening is defined by a rectangular upper section communicating with a downwardly tapering lower section terminating between the left and right leg components, and wherein the left and right downwardly depending leg components are each defined by a lower horizontal edge wherein each of the horizontal edges are aligned with one another, and wherein the rear opening is of a "D" shaped configuration, and wherein the rear panel is of a "D" shaped configuration complementary to that defined by the rear opening, and further including a continuous rear opening hook and loop fastener strip continuously formed adjacent a rear edge defining the rear opening, and the rear panel includes a rear panel hook and loop fastener strip continuously formed about the rear panel adjacent an exterior edge of the rear panel to cooperate with the rear opening hook and loop fastener strip.

* * * * *